US007637769B2

(12) United States Patent
Carreras Garcia et al.

(10) Patent No.: US 7,637,769 B2
(45) Date of Patent: Dec. 29, 2009

(54) CAP, A TERMINATION ASSEMBLY AND A HOUSING ASSEMBLY FOR A MODULAR TELECOM CONNECTION JACK

(75) Inventors: Antonio Carreras Garcia, Terrassa (ES); Josep Sanabra Jansa, Vilanova I la Geltru (ES); Longinos De Dios Martin, Barcelona (ES)

(73) Assignee: Tyco Electronics Amp Espana SA (ES)

( * ) Notice: Subject to any disclaimer, the term of this patent is extended or adjusted under 35 U.S.C. 154(b) by 0 days.

(21) Appl. No.: 11/578,863

(22) PCT Filed: Apr. 6, 2005

(86) PCT No.: PCT/EP2005/003590

§ 371 (c)(1),
(2), (4) Date: Aug. 1, 2007

(87) PCT Pub. No.: WO2005/104300

PCT Pub. Date: Nov. 3, 2005

(65) Prior Publication Data

US 2008/0102686 A1 May 1, 2008

(30) Foreign Application Priority Data

Apr. 23, 2004 (EP) ..... 04252386

(51) Int. Cl.
*H01R 4/24* (2006.01)

(52) U.S. Cl. ..... 439/392; 439/404

(58) Field of Classification Search ..... 439/391, 439/392, 395, 404, 405, 942
See application file for complete search history.

(56) References Cited

U.S. PATENT DOCUMENTS 3,634,605 A * 1/1972 Dola ..... 174/88 R (Continued)

FOREIGN PATENT DOCUMENTS

EP 0 630 07 A 12/1994

(Continued)

OTHER PUBLICATIONS

International Search Report, International Application No. PCT/EP2005/003590 dated Jul. 29, 2005, European Patent Office as International Searching Authority.

*Primary Examiner*—Thanh-Tam T Le
(74) *Attorney, Agent, or Firm*—Baker & Daniels LLP

(57) ABSTRACT

A cap (10) for a modular telecom connection jack assembly comprises a housing (12) including an aperture (14) to receive a cable (18) therethrough. A pair of jaws (20, 22) is operably associated with the housing (12) and movable relative to each other between an open configuration (Po) and a closed configuration (Pc). The relative positions of the jaws (20, 22) in the closed configuration (Pc) is determined by latch means operably associated with the jaws (20, 22) to limit relative movement of the jaws (20, 22). The cap (10) further comprises biasing means operably associated with the jaws (30, 32) to bias the jaws (20, 22) from the open configuration (Po) towards the closed configuration (Pc). The jaws (20, 22), in use, are movable to the open configuration (Po) to permit insertion of a cable (18) through the aperture (14) in the housing (12) and, on release, are caused to move by the biasing means towards the closed configuration (Pc) to clamp the cable (18) therebetween. The cap (10) may be used in combination with a termination assembly (44) and/or a housing assembly (62).

18 Claims, 11 Drawing Sheets

U.S. PATENT DOCUMENTS

| | | | | | |
|---|---|---|---|---|---|
| 3,835,444 | A | * | 9/1974 | Plana et al. | 439/392 |
| 4,284,316 | A | * | 8/1981 | Debaigt | 439/392 |
| 4,444,447 | A | | 4/1984 | Markwardt et al. | |
| 4,552,429 | A | * | 11/1985 | van Alst | 439/404 |
| 4,679,881 | A | * | 7/1987 | Galvin et al. | 439/392 |
| 4,838,811 | A | | 6/1989 | Nakamura et al. | |
| 5,021,610 | A | | 6/1991 | Roberts et al. | |
| 5,118,305 | A | | 6/1992 | Hell et al. | |
| 5,224,868 | A | | 7/1993 | Tseng et al. | |
| 5,762,517 | A | * | 6/1998 | Abe | 439/402 |
| 6,193,554 | B1 | | 2/2001 | Wu | |
| 6,254,420 | B1 | * | 7/2001 | Letailleur et al. | 439/392 |
| 6,364,707 | B1 | | 4/2002 | Wang | |

FOREIGN PATENT DOCUMENTS

| | | | |
|---|---|---|---|
| EP | 0 871 243 | A | 1/1998 |
| EP | 0 991 139 | A | 4/2000 |
| EP | 1 251 601 | A | 1/2002 |
| FR | 2 488 452 | A | 2/1982 |
| GB | 637 004 | A | 5/1950 |

* cited by examiner

CAP, A TERMINATION ASSEMBLY AND A HOUSING ASSEMBLY FOR A MODULAR TELECOM CONNECTION JACK

The invention relates to a cap, a termination assembly and a housing assembly for a modular telecom connection jack and, in particular, for an electromagnetically shielded modular telecom connection jack.

According to a first aspect of the invention there is provided a cap for a modular telecom connection jack comprising a housing including an aperture to receive a cable therethrough and a pair of jaws operably associated with the housing and movable relative to each other between an open configuration and a closed configuration, the relative positions of the jaws in the closed configuration being determined by latch means operably associated with the jaws to limit relative movement of the jaws, the cap further comprising biasing means operably associated with the jaws to bias the jaws from the open configuration towards the closed configuration, the jaws, in use, being movable to the open configuration to permit insertion of a cable through the aperture in the housing and, on release, being caused to move by the biasing means towards the closed configuration to clamp the cable therebetween.

According to a second aspect of the invention there is provided a termination assembly for a modular telecom connection jack comprising a contact block and a cutting member, the contact block having an insulation displacement contact, the contact block and cutting member being insertable into a housing assembly such that the cutting member is aligned with and spaced from the insulation displacement contact, the cutting member defining a cutting blade which severs wire protruding from the insulation displacement contact to remove excess wire and define a wire tail extending from the contact when a wire is pressed into the insulation displacement contact, wherein a tail-receiving space is located relative to the cutting blade to receive and so avoid electrical contact with the free end of the wire tail.

According to a third aspect of the invention there is provided a housing assembly for a modular telecom connection jack comprising a housing defining a socket for receiving a plug, the housing containing an electromagnetic shielding component for electrical contact with the electromagnetic shielding component of a plug inserted into the socket, the jack further including at least one electrically conductive contact member located within the socket, the or each contact member including a support body and a contact portion overlying the support body such that the support body is in face-to-face contact with the electromagnetic shielding components of the housing and the contact portion is in electrical contact with the shielding component of the plug when the plug is inserted into the socket.

Embodiments of the invention will now be described, by way of non-limiting examples, with reference to the accompanying drawings in which.

Figure 7:
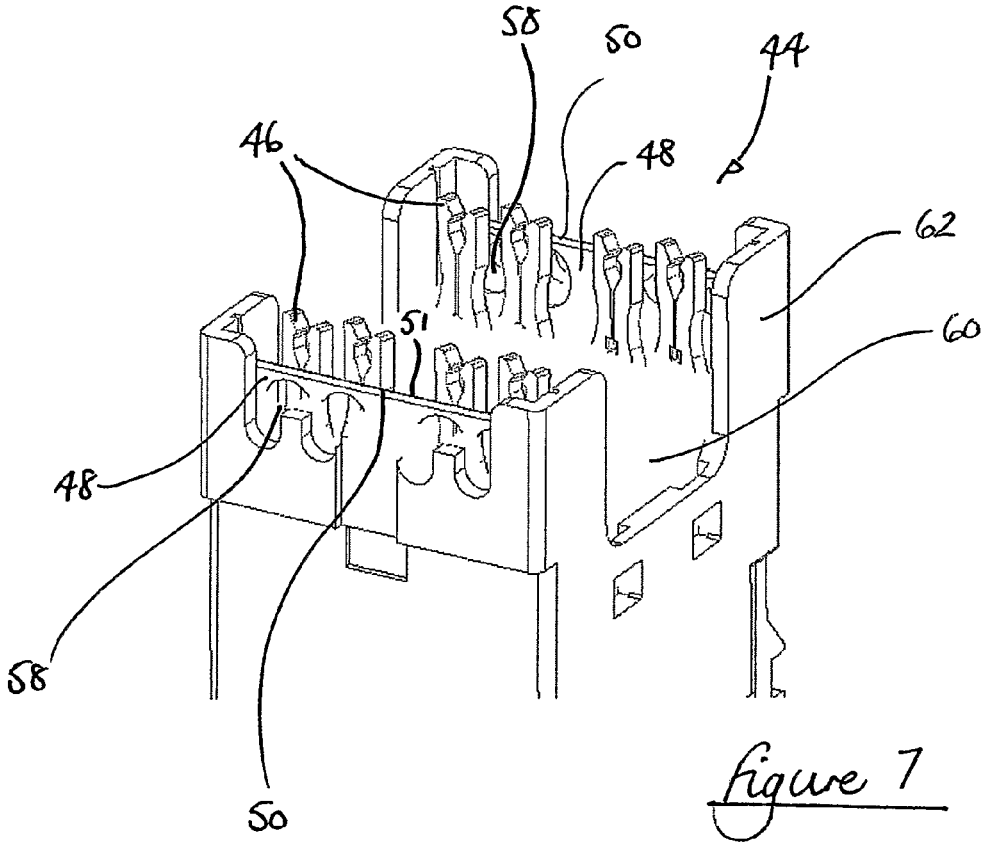
FIG. 7 shows a termination assembly for a modular telecom connection jack according to another embodiment of the invention.
Figure 10:
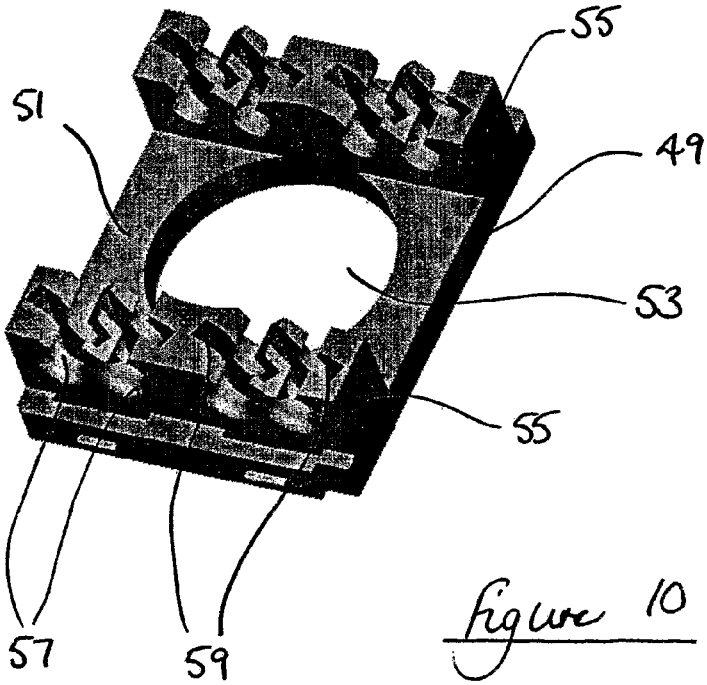
FIG. 10 shows a lacing fixture of the termination assembly of FIG. 7.
Figure 11A:
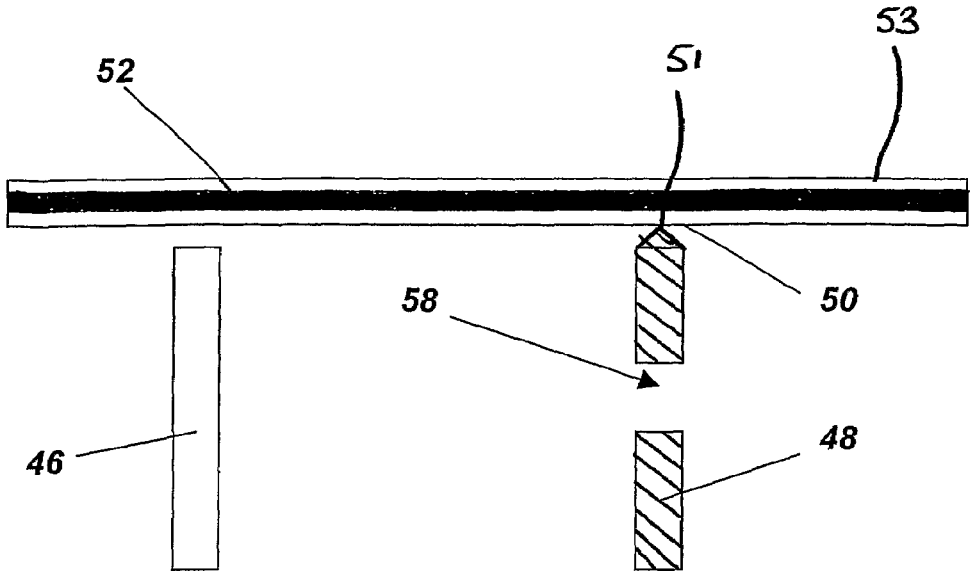
Figure 11B:
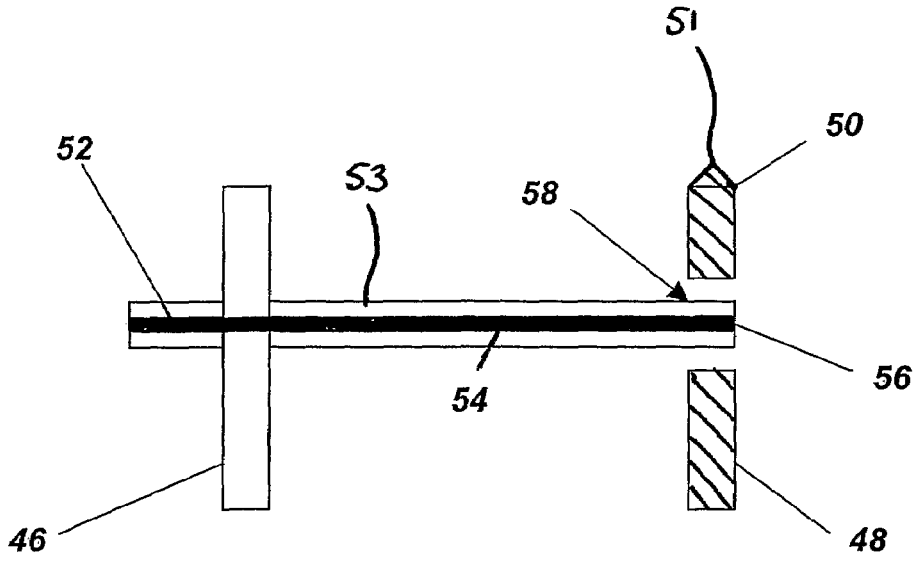
Figure 12:
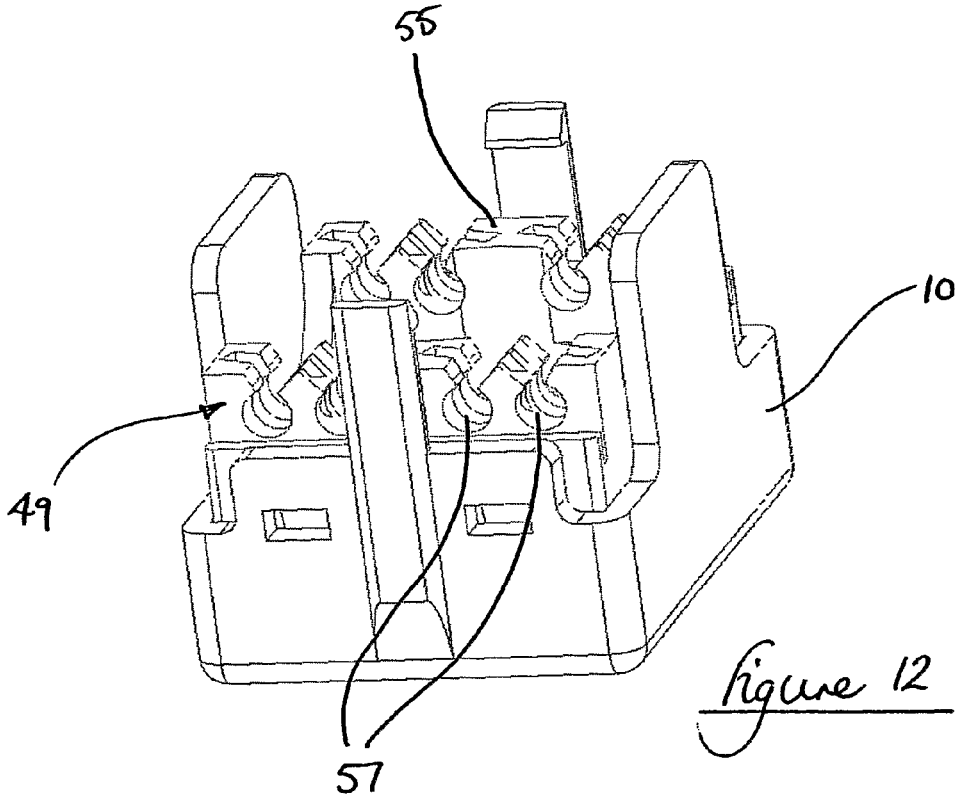
Figure 13:
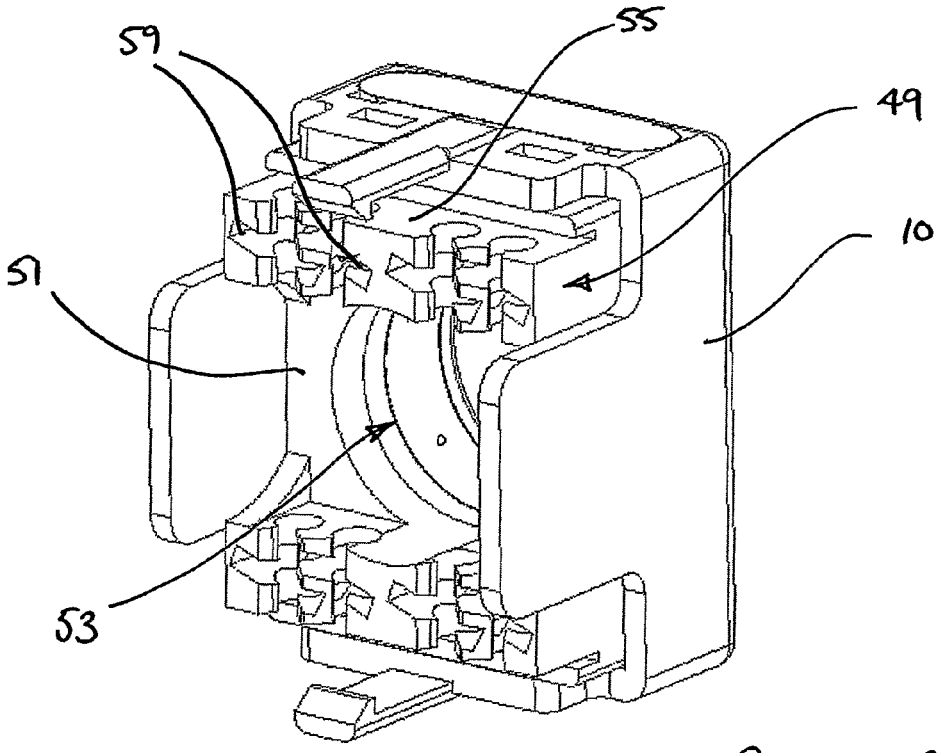
Figure 14:
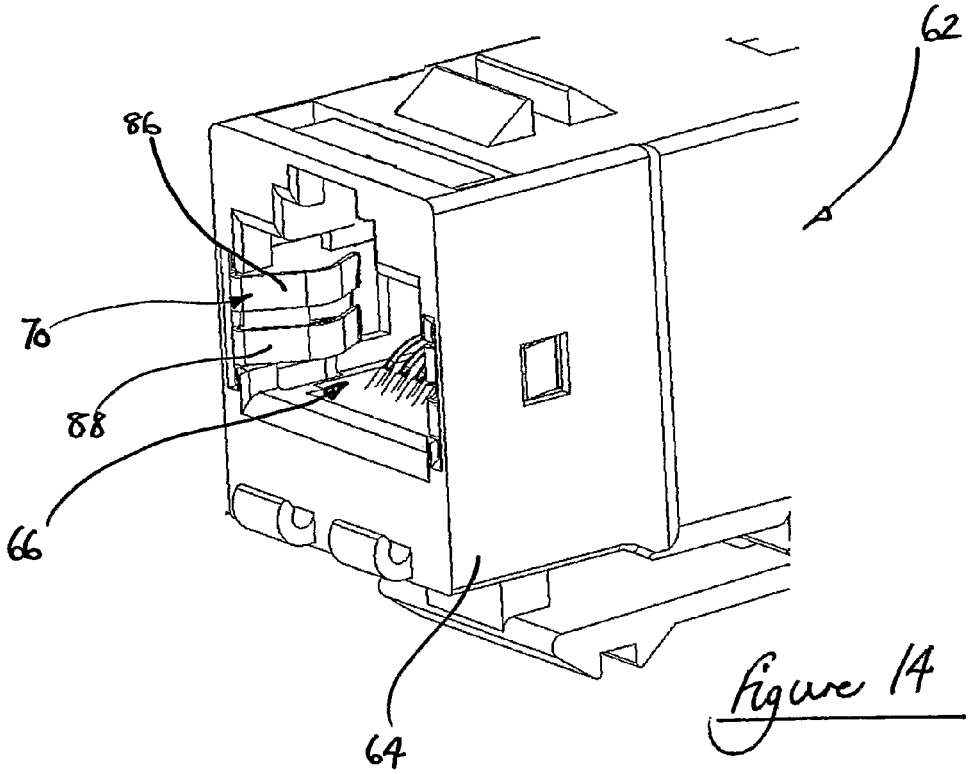
Figure 15:
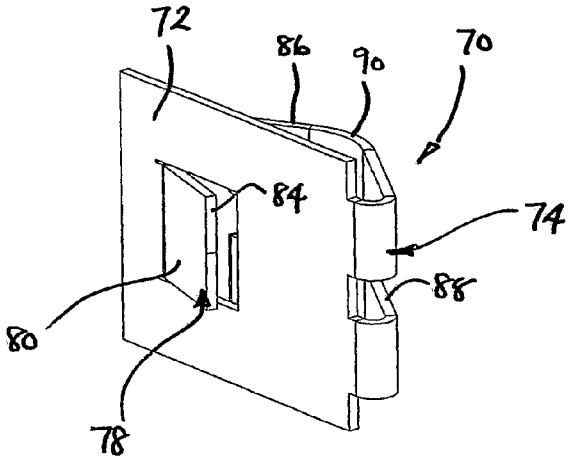
Figure 16:
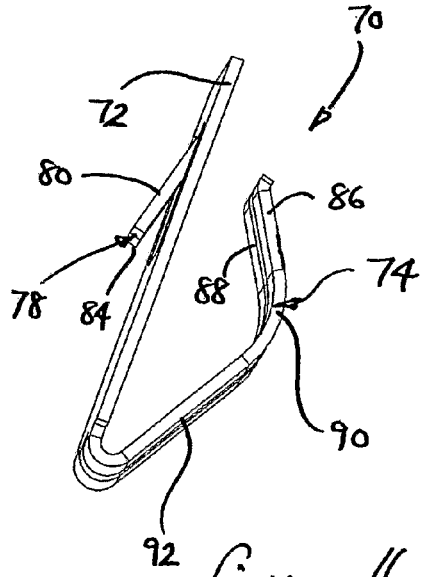
Figure 17:
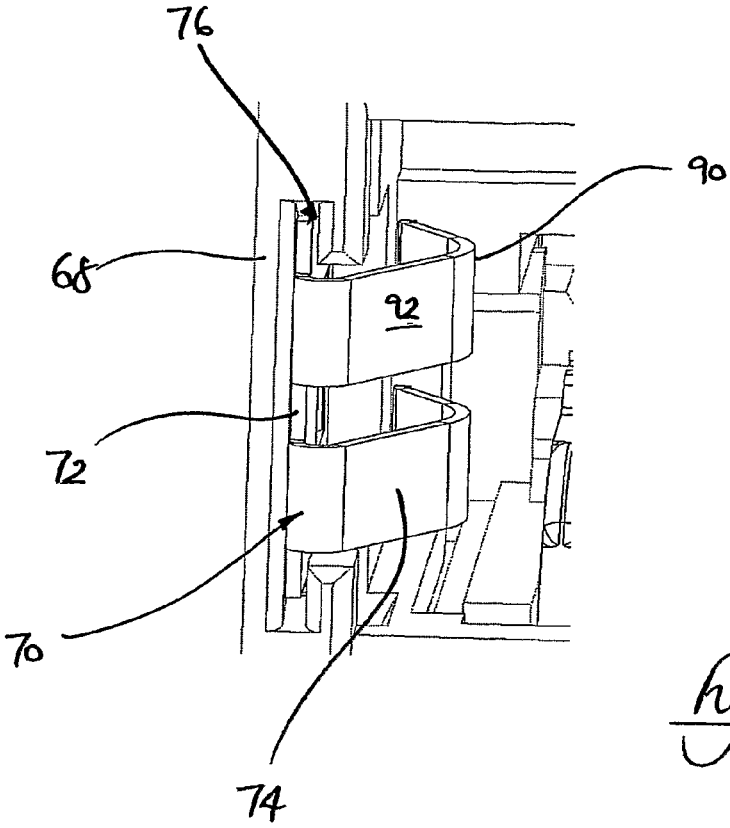

FIGS. 11*a* and 11*b* show schematic views of the termination assembly of FIG. 7 during termination of a wire;

FIGS. 12 and 13 show the lacing fixture of FIG. 10 located within a cap of a modular telecom connection jack;

FIG. 14 shows a housing assembly for a modular telecom connection jack according to a further embodiment of the invention;

FIGS. 15 and 16 show a contact member of the housing assembly of FIG. 14;

FIGS. 17-20 show further views of the housing assembly of FIG. 14; and

Figure 1:
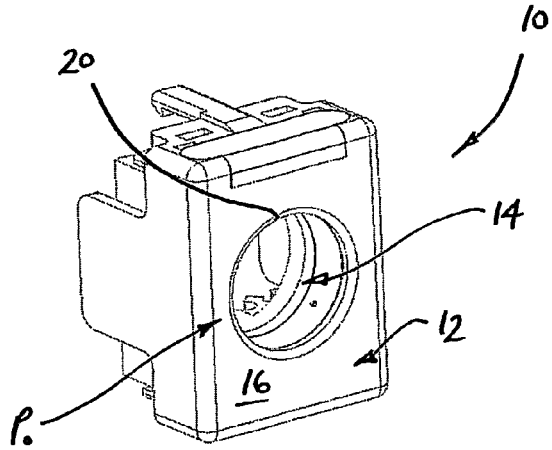
FIG. 1 shows a cap for a modular telecom connection jack according to an embodiment of the invention showing the jaws of the cap in an open configuration.
Figure 21:
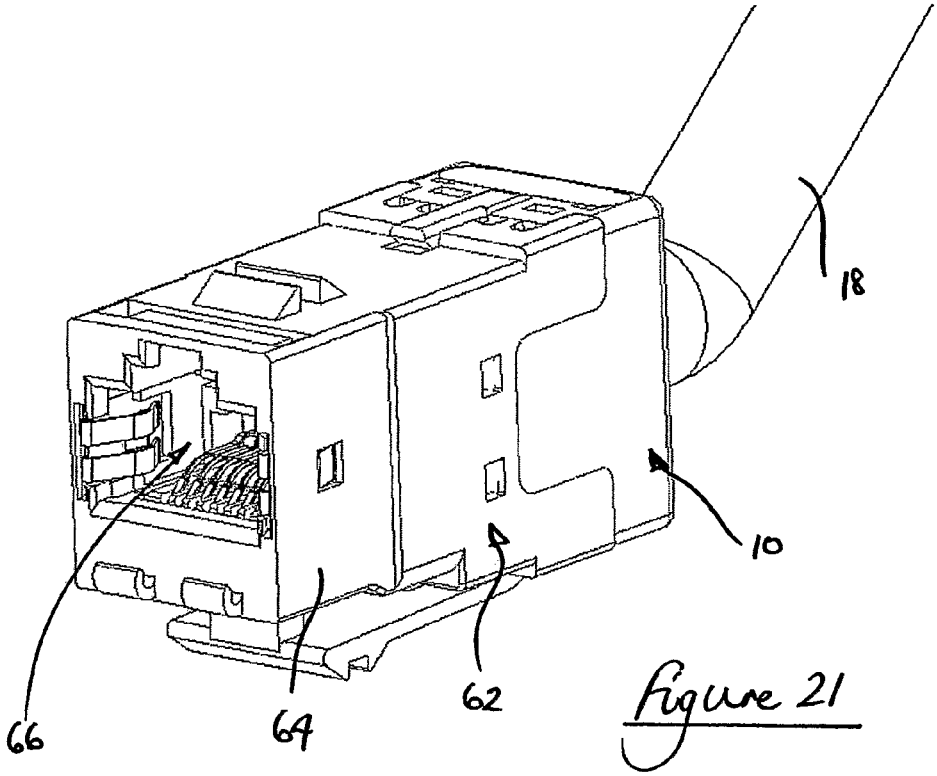
Figure 22:
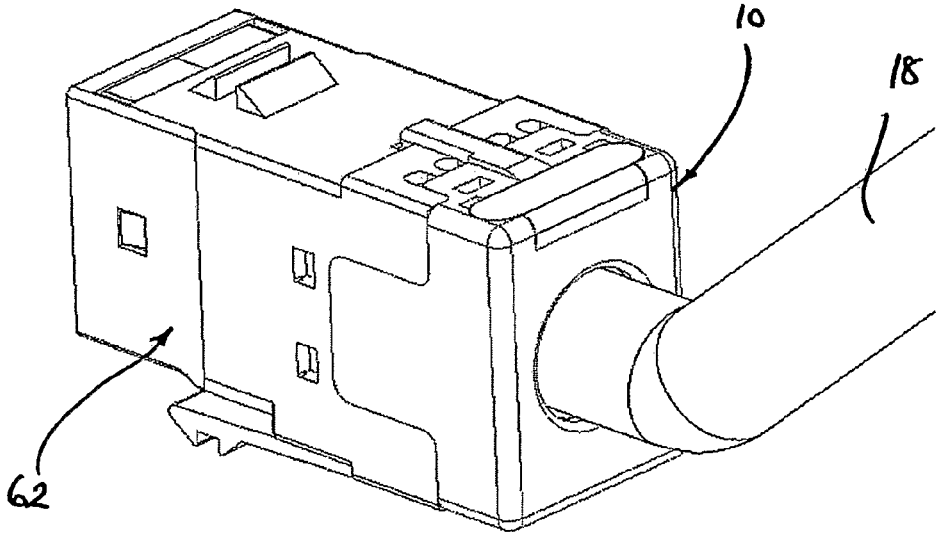

FIGS. 21 and 22 show a modular telecom connection jack incorporating the cap of FIG. 1 and the housing assembly of FIG. 14.

A cap 10 for a modular telecom connection jack, according to an embodiment of the invention, is shown in FIG. 1.

Figure 2:
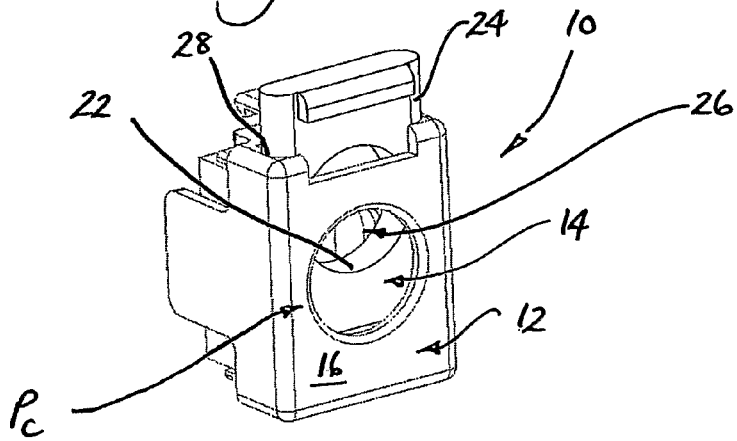
FIG. 2 shows the cap of FIG. 1 showing the jaws of the cap in a closed configuration.

The cap 10 includes a housing 12 having an aperture 14 formed in a sidewall 16 to receive a cable 18 (FIG. 3) therethrough. A pair of jaws 20,22 is operably associated with the housing 12, the jaws 20,22 being movable relative to each other between an open configuration $P_o$, illustrated in FIG. 1, and a closed configuration $P_c$, illustrated in FIG. 2.

The relative positions of the jaws 20,22 in the closed configuration $P_c$ are determined by latch means operably associated with the jaws 20,22 to limit relative movement of the jaws 20,22.

The cap 10 also includes biasing means, described in more detail hereinbelow, operably associated with the jaws 20,22 to bias the jaws 20,22 from the open configuration $P_o$ towards the closed configuration $P_c$.

In use, the jaws 20,22 are movable to the open configuration $P_o$ to permit the insertion of a cable 18 through the aperture 14 in the housing 12. On release, the biasing means causes the jaws 20,22 to move towards the closed configuration $P_c$ to clamp the cable 18 therebetween.

In the embodiment shown in FIG. 1, the circumferential edge of the aperture 14 formed in the housing 12 defines one of the pair of jaws 20.

The cap 10 further includes a clamp member 24 movably mounted in the housing 12. An aperture 26 is formed in the clamp member 24, and the circumferential edge of the aperture 26 defines the other of the pair of jaws 22.

The clamp member 24 is, preferably, a generally planar member slidably received in a slot 28 formed in the housing 12 so that, on insertion of the clamp member 24 into the slot 28, the clamp member 24 lies in face-to-face contact with the inner surface of the sidewall 16 of the housing 12.

In the embodiment shown in FIG. 1, the apertures 14,26 provided in the housing 12 and the clamp member 24 are substantially identical in size and shape. In this embodiment, the open configuration $P_o$ of the jaws 20,22 is defined when the clamp member 24 is slidably received in the slot 28 so that the apertures 24,26 are aligned.

The closed configuration $P_c$ of the jaws 20,22 is defined when the clamp member 24 is slidably received in the slot 28 so that the apertures 14,26 are misaligned.

Figure 4:
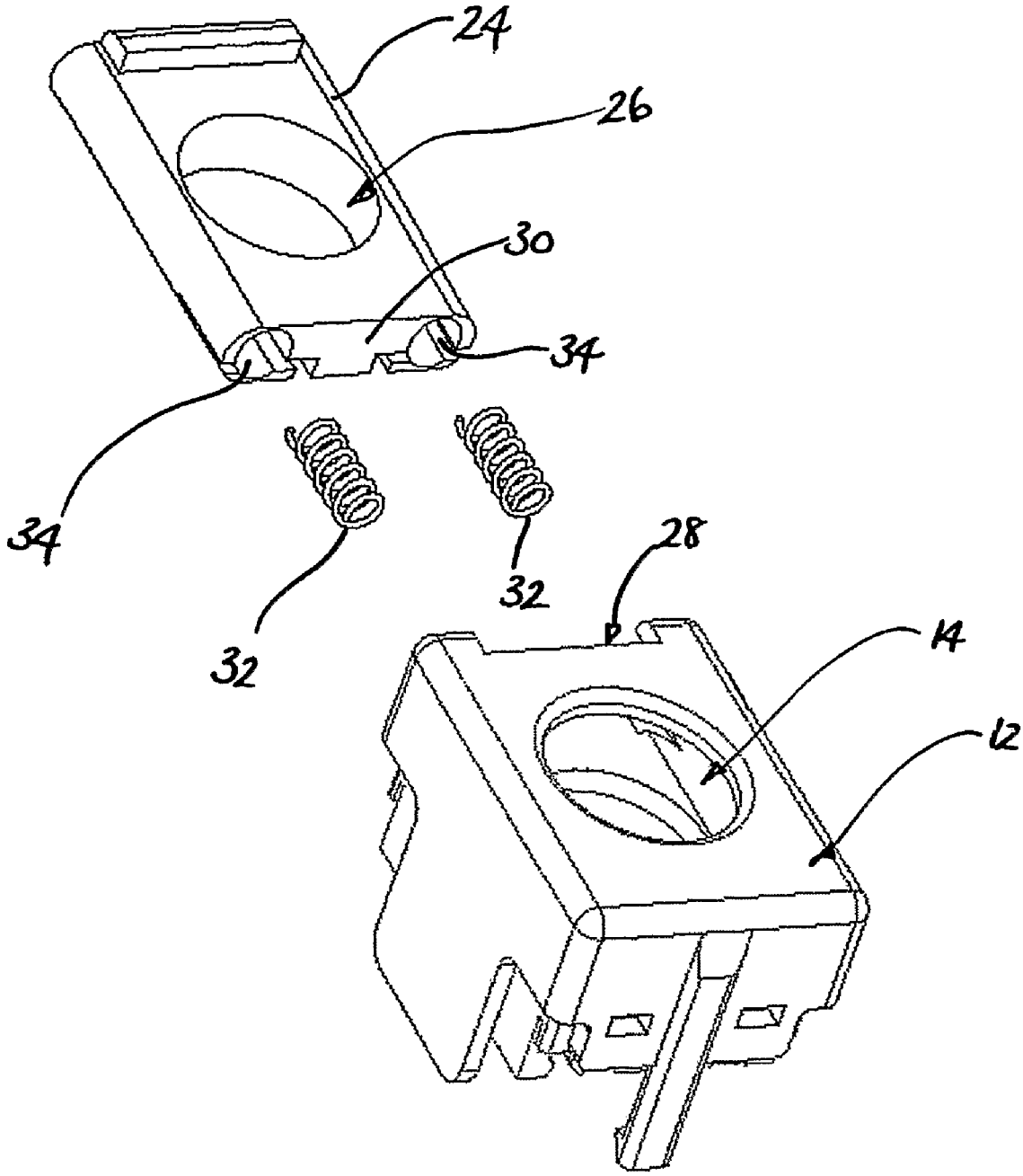
FIGS. 4-6 show the cap of FIG. 1 during assembly.

The biasing means preferably includes one or more springs held captive between the bottom edge 30 of the clamp member 24 and the bottom of the slot 28 so as to act therebetween. In the embodiment shown in FIG. 1, two springs in the form of compression springs 32 are provided. Each of the springs 32 is received at one end in a recess 34 (FIG. 4) formed in the bottom edge 30 of the clamp member 24 for contact at its other end with the bottom of the slot 28.

The provision of recesses 34 is advantageous in that it enables the springs 32 to be located in the recesses 34 prior to insertion of the clamp member 24 into the slot 28, during assembly of the cap 10, to ensure that the springs 32 are held captive between the bottom edge 30 of the clamp member 24 and the bottom of the slot 28 once the cap 10 is assembled.

In other embodiments of the invention, each of the compression springs 32 may be received at its other end in a recess in the bottom of the slot 28 for contact at the one end with the bottom edge 30 of the clamp member 24; or each of the compression springs 32 may be received at both ends within recesses formed respectively in the bottom edge 30 of the clamp member 24 and the bottom of the slot 28.

The latch means operably associated with the jaws 20,22 preferably includes one of more latch members formed on the clamp member 24 and a corresponding number of co-operable latch members formed on an inner surface of the housing 12.

Figure 5:
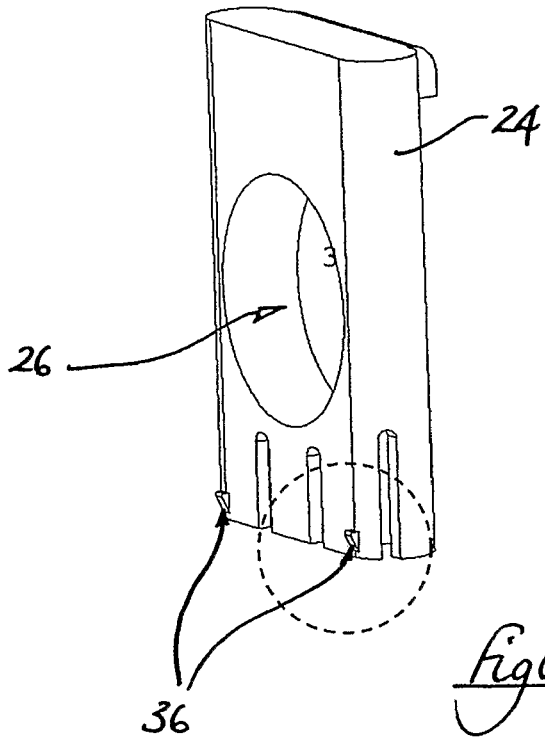
Figure 6:
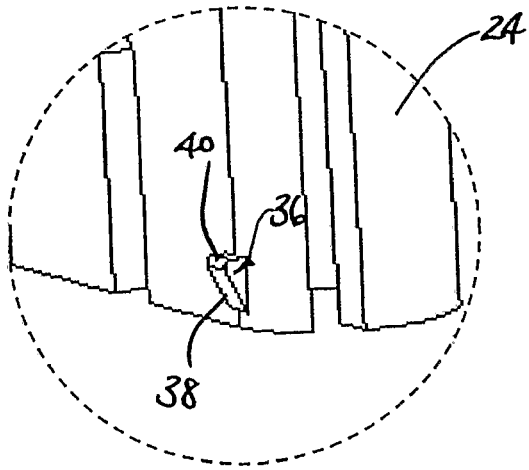

In the embodiment shown in FIG. 1, a pair of tapered retention members 36 (FIGS. 5 and 6) is provided on the clamp member 24 for engagement within elongated recesses (not shown) formed in an inner surface of the housing 12 within the slot 28.

Each of the tapered retention members 36 is resiliently deformable and is oriented on the clamp member 24 so as to present a tapered leading edge 38 on insertion of the clamp member 24 into the slot 28, during assembly of the cap 10, so that the retention members 36 do not impede insertion. The tapered leading edge 38 terminates in a shoulder 40, which snap-fittingly engages within a corresponding recess once the clamp member 24 is inserted into the slot 28. On outward movement of the clamp member 24 from the slot 28, the shoulder 40 is brought into contact with the top of the recess. This engagement prevents further outward movement of the clamp member 24 from the slot 28.

The size of the or each spring biasing the clamp member 24 in an outward direction relative to the length of the slot 28 is preferably chosen such that the pre-load stored in the spring held captive between the clamp member 24 and the bottom of the slot 28 maintains the or each retention member 26 in engagement with the top of the corresponding recess.

The housing 12 preferably includes an electromagnetic shielding component, which is exposed within the inner circumferential edge of the aperture 14 formed in the sidewall 16 of the housing 12. The housing 12 may, for example, be formed from metal, itself forming the electromagnetic shielding component. In the embodiment shown in the FIG. 1, the housing 12 is formed from die-cast metal.

Preferably, the clamp member 24 is also an electrically conductive member. In the embodiment shown in FIG. 1, the clamp member 24 is also formed from die-cast metal.

To permit insertion of a cable 18 through the apertures 14,26 formed in the housing 12 and the clamp member 24, during assembly of a modular telecom connection jack, the clamp member 24 is pushed into the slot 28, against the bias provided by the compression springs 32, so as to align the apertures 14,26 and thereby move the jaws 20,22 to their open configuration $P_o$.

The jaws 20,22 are held e.g. manually in their open configuration $P_o$, against the spring bias, while the cable 18 is passed through the apertures 14,26. The jaws 20,22 are then released, and the bias provided by springs 32 drives the clamp member 24 in an outward direction relative to the length of the slot 28.

The positions of the elongated recesses provided in the inner wall of the slot 28, to co-operate with the retention members 36 provided on the clamp member 24, are chosen such that the distance separating the jaws 20,22 in their closed configuration $P_c$ is less than the diameter of any cable 18 intended to be passed through the apertures 14,26. This ensures that, on releasing the clamp member 24, the bias provided by the springs 32 forces the jaw 22 defined by the circumference of the aperture 26 formed in the clamp member 24 against the cable 18.

Figure 3:
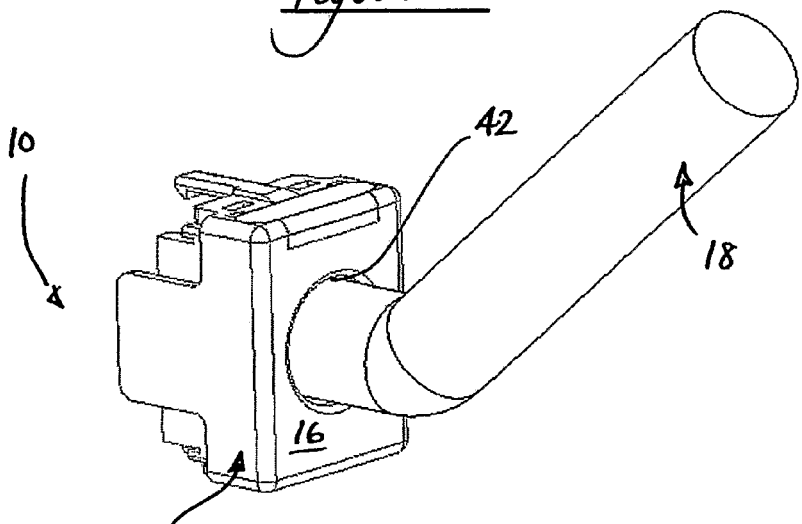
FIG. 3 shows the cap of FIG. 1 in use.

Continued upward movement of the clamp member 24 under the influence of the bias provided by springs 32 forces the cable 18 against the jaw 20 defined by the circumference of the aperture 14 formed in the sidewall 16 of the housing 12, thereby clamping the cable 18 between the jaws 20,22, as shown in FIG. 3.

The continued application of the spring bias to the clamp member 24 maintains the clamping force until the clamp member 24 is pressed into the slot 18 against the spring bias. The grip provided by the jaws 20,22 therefore prevents the cable 18 from being pulled out of the cap 10.

The cable 18 shown in FIG. 3 includes an electromagnetic shield in the form of a metal braided sheath 42. The metal braided sheath 42 is preferably exposed prior to insertion of the cable 18 through the apertures 14,26 in the housing 12 and the clamp member 24. The cable 18 is then arranged such that the metal braided sheath 42 is positioned between the jaws 20,22.

Since the housing 12 and the clamp member 24 in this embodiment are formed from die-cast metal, the spring bias forcing the jaw 20 defined by the circumferential edge of the aperture 14 in the sidewall 16 of the housing 12 into contact with the cable 18 maintains constant electrical contact between the housing 12 and the clamp member 24 and the metal braided sheath 42 of the cable 18. The provision of the spring bias also ensures that relaxation of the cable 18 over time does not adversely affect the electrical contact since the spring bias maintains the jaw 20 in contact with the cable 18. The spring bias therefore helps to achieve a long-life contact between the housing 12 and the clamp member 24 and the metal braided sheath 42 of the cable 18, which in turn ensures that the transfer impedance does not deteriorate with use.

Since the jaws 20,22 are biased towards their closed configuration $P_c$, the jaws 20,22 may accommodate a range of different cables, which vary in diameter, whilst continuing to clamp the cable 18.

Once a cable 18 is passed through the cap 10, it is preferably terminated in a termination assembly for a modular telecom connection jack.

A termination assembly 44 for a modular telecom connection jack, according to another embodiment of the invention, is shown in FIG. 7.

Figure 8:
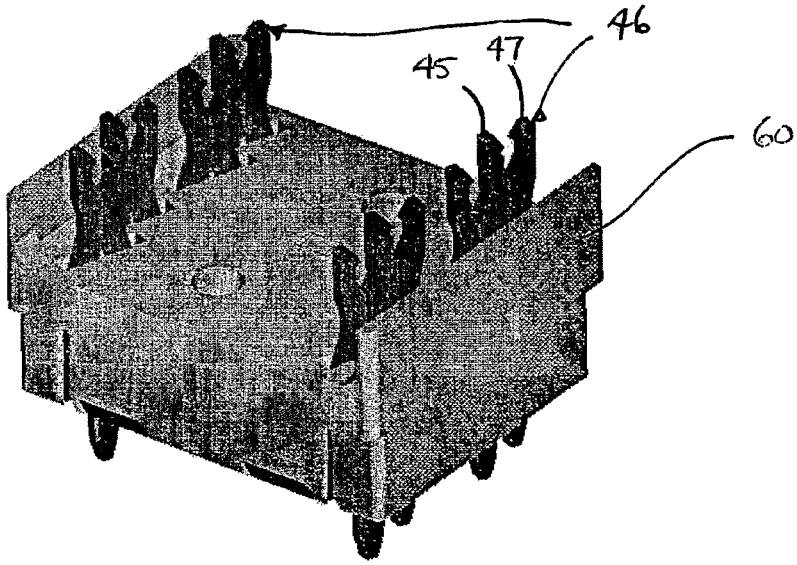
FIG. 8 shows a contact block of the termination assembly of FIG. 7.
Figure 9:
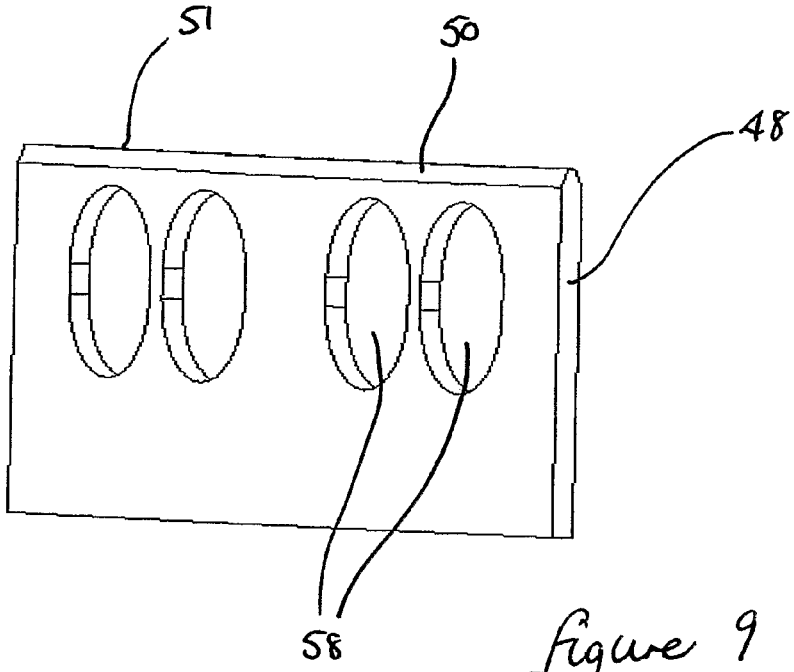
FIG. 9 shows a cutting member of the termination assembly of FIG. 7.

The termination assembly 44 includes a contact block 60 (FIG. 8) and a cutting member 48 (FIG. 9), the contact block 60 including an insulation displacement contact 46 (hereinafter referred to as an IDC) protruding therefrom. The IDC 46 includes a pair of opposed limbs 45,47 which cut the insulation surrounding a wire 52 when the wire 52 is pressed into the IDC 46, between the opposed limbs 45,47.

The contact block 60 and cutting member 48 are insertable into a housing assembly 62, as shown in FIG. 7, such that the cutting member 48 is aligned with and spaced from the IDC 46.

The cutting member 48 defines a cutting blade 50, which severs wire 52 protruding from the IDC 46 to remove excess wire and define a wire tail 54 extending from the IDC 46 when a wire 52 is pressed into the IDC 46, as illustrated schematically in FIGS. 11*a* and 11*b*.

On further pressing movement of the wire 52 into the IDC 46, after removal of the excess wire, the free end 56 of the wire tail 54 brushes across the surface of the cutting member 48 below the cutting blade 50 until it reaches tail-receiving space. The tail-receiving space receives the free end 56 of the wire tail 54, and avoids electrical contact of the blade with the cut end of the wire tail 54.

In the embodiment shown in FIG. 7, the cutting member 48 is a planar member (FIG. 9) having a sharpened edge 51, which defines the cutting blade 50. An aperture 58 is formed in the planar member, below the cutting blade 50, to define tail-receiving space to receive the free end 56 of the wire tail 54.

It is envisaged that other openings may be employed to define tail-receiving space in other embodiments. For example, the cutting member 48 may include a recess formed below the cutting blade 50, or the cutting member 48 may be shaped to define a recessed channel below the cutting blade 50.

Generally a cable 18 contains a plurality of wires 52 for termination in the termination assembly 44. The termination assembly 44 therefore requires a corresponding number of IDC's 46. Preferably, the IDC's 46 are arranged in pairs in a side-by-side configuration.

In the embodiment shown in FIG. 7, the termination assembly 44 includes four pairs of IDC's 46 protruding from the contact block 60, to define two rows of IDC's 46, and a pair of cutting members 48. The cutting members 48 are insertable into the housing assembly 62 so that each of the cutting members 48 is aligned with and spaced from a respective row of IDC's 46.

Each of the cutting members 48 corresponds in length to the adjacent row of IDC's 46, and includes four apertures 58, one for each of the IDC's 46 in the adjacent row.

Preferably, the termination assembly 44 further includes a lacing fixture 49 (FIG. 10).

The lacing fixture 49 shown in FIG. 10 includes a planar body 51 defining a centrally-located aperture 53 and two holding members 55 protruding from opposite edges of the body 51.

Each of the holding members 55 defines four recesses 57 spaced along its length to receive and hold wires 52. Slots 59 are also formed in each of the holding members 55, each of the slots 59 being arranged so as to intersect a corresponding recess 57.

Each of the slots 59 corresponds in position, size and shape to a corresponding IDC 46 protruding from the contact block 60.

In use, the lacing fixture 49 is preferably secured within a cap for a modular telecom connection jack, as shown in FIGS. 12 and 13. The cap shown in FIGS. 12 and 13 corresponds to the cap 10 described with reference to FIGS. 1-6. Consequently corresponding reference numerals will be used. However, it is envisaged that the termination assembly 44 may be used in combination with other caps.

The rear surface of the body 51 of the lacing fixture 49 is secured to an inner surface of the sidewall 16 of the cap 10 such that the centrally-located aperture 53 is aligned with apertures 14,26.

Once the cable 18 is passed through the apertures 14,26 in the cap 10, and clamped or otherwise secured in position relative to the cap 10, the metal braided sheath 42 surrounding the ends of the wires 52 in the cable 18 is removed to expose the ends of the wires 52. The wires 52 are then arranged such that each wire 52 is positioned within a corresponding recess 57 defined in the holdings members 55 of the lacing fixture 49.

The cap 10 is aligned with the housing assembly 62 such that the opening of each of the slots 59 formed in the holding members 55 of the lacing fixture 49 is aligned with a corresponding IDC 46. The cap 10 is then pushed into engagement with the housing assembly 62 so that each of the slots 59 envelops the corresponding IDC 46.

Since each of the slots 59 intersects a corresponding recess 57 formed in the holding member 55, and a wire 52 is located in each of the recesses 57, the step of pushing the cap 10 into engagement with the housing assembly 62 causes each of the wires 52 to be pushed into a corresponding IDC 46.

On pressing each wire 52 into a corresponding IDC 46, opposed limbs of the IDC 46 break the insulation 53 surrounding the wire 52 and create an electrical contact between the wire 52 and the IDC 46. At the same time, excess wire protruding from the IDC 46 is pushed down onto the cutting blade 50 of the cutting member 48. The cutting blade 50 severs the excess wire, thereby defining a wire tail 54 extending from the IDC 46.

The apertures 58 in the cutting member 48 are aligned with the respective IDC's 46 such that on continued movement of the wires 52 into the IDC's 46, each of wire tails 54 is received in the opening defined by a corresponding aperture 58. The aperture 58 then serves to avoid contact of the cut end of the wire tail 54 with the cutting member 48, thereby preventing short-circuiting which may otherwise be caused should the cut end of the wire tail 54 contact the cutting member 48.

The termination assembly 44 is easily re-usable since each of the wires 52 can be withdrawn from the respective IDC 46, thereby allowing a new wire 52 to be pushed into the IDC 46 for termination.

The provision of a lacing fixture 49 allows easy termination of a plurality of wires 52 in a single step since it serves to hold the wires 52 in position relative to each other so that each of the wires 52 may be aligned with a corresponding IDC 46 easily. It also provides a means for pushing the wires into respective IDC's 46 at the same time as each other, thereby ensuring that the step of terminating the wires 52 is a relatively quick procedure.

It is envisaged however that the lacing fixture may be omitted in other embodiments, and each wire 52 may be pushed into a corresponding IDC 46 individually.

On insertion of the contact block 60 into a housing assembly 62, each of the IDC's 46 is connected to a printed circuit board (not shown) provided in the housing assembly 62, preferably by welding. The printed circuit board is, in turn, connected to a series of electrical contacts located in a socket in the housing assembly 62. Thus, on termination of the wires 52 in the termination assembly 44, electrical contact is created between the wires 52 and the contact elements located in the socket.

A housing assembly 62 including a socket 66, according to a further embodiment of the invention, is shown in FIG. 14.

The housing assembly 62 includes a housing 64 defining a socket 66 to receive a plug. The housing 64 contains an electromagnetic shielding component for electrical contact with the electromagnetic shielding component of a plug inserted in the socket 66.

The housing assembly 62 also includes at least one electrically conductive contact member 70 (FIGS. 15 and 16) located within the socket 66. The or each contact member 70 includes a support body 72 and a contact portion 74 overlying the support body 72.

The or each contact member 70 is arranged within the socket 66 so that the support body 72 lies in face-to-face contact with the electromagnetic shielding component of the housing 64, and the contact portion 74 is compressed between the electromagnetic shielding components of the housing 64 and the plug when a plug is inserted into the socket 66.

The housing 64 may be formed from metal, itself forming the electromagnetic shielding component. In the embodiment shown in FIG. 14 the housing 64 is formed from die-cast metal, and two contact members 70 are located on opposite sides of the socket 66.

Each of the contact members includes a planar support body 72 slidably receivable in a slot 76 (FIGS. 17 and 18) formed in the sidewall 68 of the housing 64.

Each of the slots 76 is preferably formed in the sidewall 68 so that the electromagnetic shielding component is exposed on the inner surface of the outer wall of the slot 76 for face-to-face contact with the outer surface of a respective support body 72 when the support body 72 is inserted into the slot 76.

The planar support body 72 of each of the contact members 70 preferably includes a resilient latch member 78 defined by a flap protruding from the outer surface of the support body 72 so as to present tapered surface 80 on insertion of the support body 72 into the slot 76.

Figure 18:
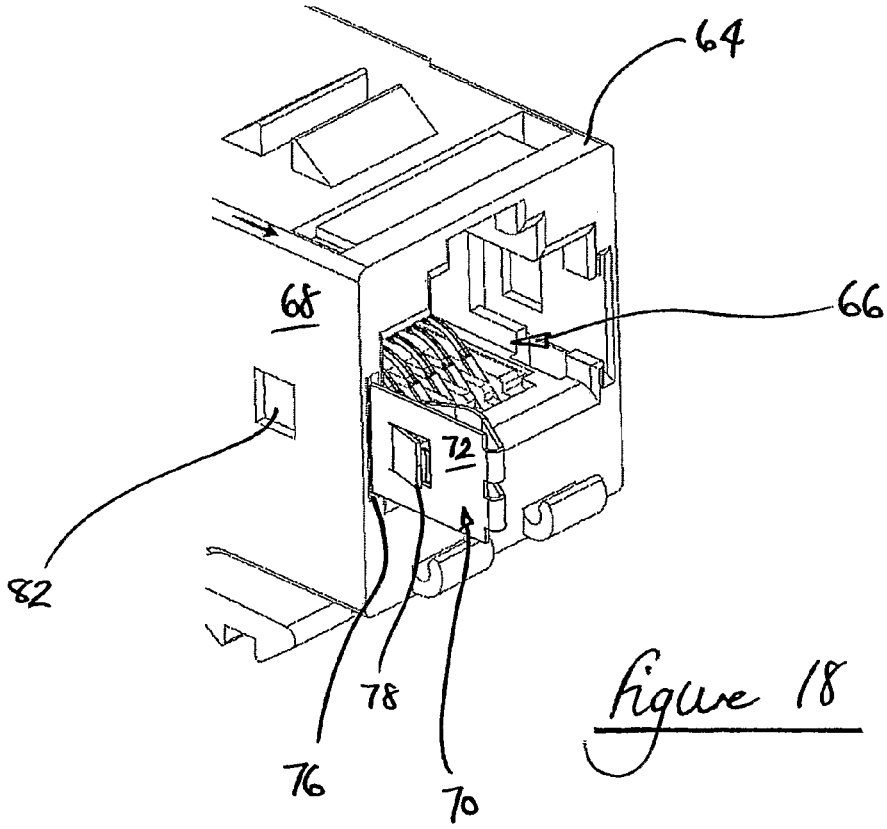
Figure 19:
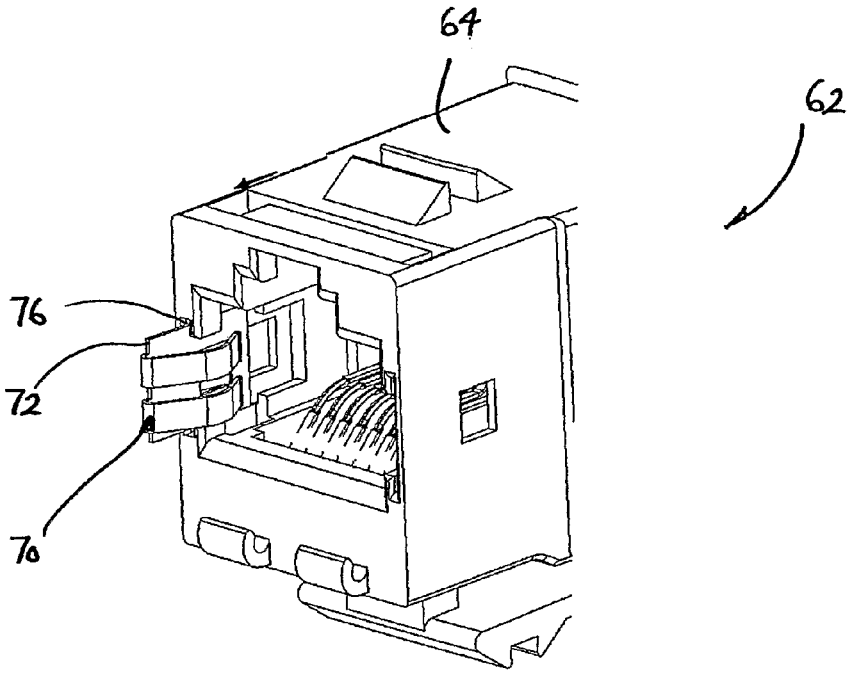

On insertion of the support body 72 into the slot 76, as illustrated in FIGS. 18 and 19, engagement of the outer wall of the slot 76 on the latch member 78 pushes the latch member 78 against the support body 72, allowing the support body 72 to slide into the slot 76.

A window 82 is formed in the outer wall of the slot 76 at a position corresponding in position to the latch member 78 when the support body 72 is fully inserted into the slot 76 to receive the latch member 78.

Figure 20:
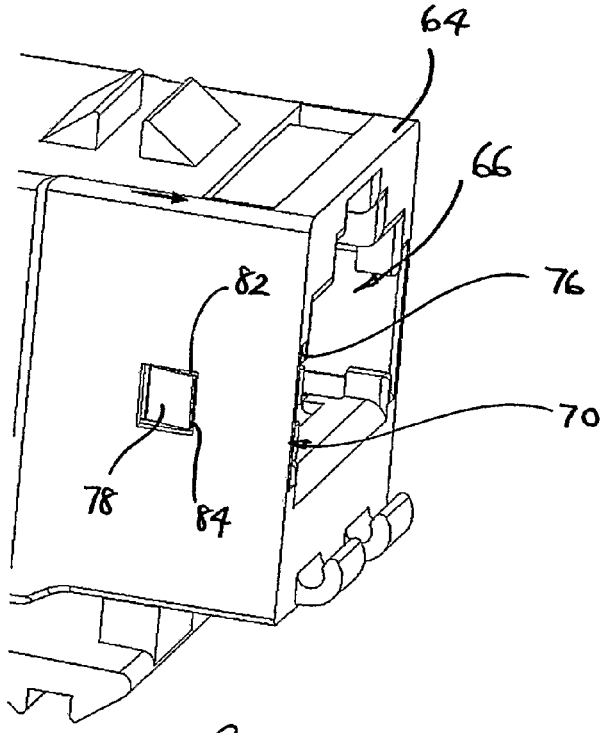

Once the support body is fully inserted into the slot 76, the window 82 allows the latch member 78 to protrude outwardly from the support body 72 and into the window 82 (FIG. 20). Engagement between the shoulder 84 defined by the outwardly protruding latch member 78 and the side of the window 82 prevents outward movement of the support body 74 from the slot 76, thereby locking the support body 74 in place.

The support body 72 can be removed, if required, by pushing the latch member 78 back through the window 82 from the outside of the housing 64 to disengage the shoulder 84 from the side of the window 82.

The contact portion 74 of each contact member is preferably defined by two resilient arms 86,88 extending from the end of the support body 72 and folded over so as to overlie the support body 72.

Each of the arms 86,88 is folded to extend outwardly from the support body 72 to an elbow 90 before extending back towards the support body 72 and thereby define generally v-shaped contact portions 74. The free ends of the arms 86,88 are spaced from the support body 72 so that the arms 86,88 slide past the opposite side of an inner wall of the slot 76 on insertion of the support body 72 into the slot 76 to locate the arms 86,88 within the socket 66.

The general v-shape of the contact portions 74 means that the contact portions 74 present inwardly tapering contact surfaces 92 at the entrance of the socket 66. On insertion of a plug into the socket 66, the plug rides along the contact surfaces 92 pushing the resilient arms 86,88 outwardly.

The resilient nature of each of the arms 86,88 means that on compression of the arms 86,88 between the plug and the sidewall of the housing 64 contact is maintained between the elbow 90 of each of the arms and the electromagnetic shielding component provided on the exterior surface of the plug.

During compression of the arms 86,88 between the plug and the sidewall of the housing 64, the outer surface of the support body 72 is pushed against the electromagnetic shielding component of the housing 64, thereby maintaining contact between the support body 72 and the electromagnetic shielding component of the housing 64.

The contact members 70 thereby provide an effective means for ensuring constant contact between the electromagnetic shielding components of the socket assembly 62 and the plug while the plug is inserted in the socket 66.

The provision of one or more slots 76 accessible from the opening of the socket 66 also means that it is possible to insert the or each contact member 70 easily from the front of the socket 66, the provision of a latch member 78 on each contact member 70 preventing unwanted withdrawal of the contact member 70, but allowing replacement of the contact member 70 if necessary.

The spring bias provided by the resilient nature of the arms 86,88 also means that, in embodiments where a contact member 70 is provided on each side of the socket 66, the arms 86,88 assist in locating the plug within the socket 66 and hold it firmly in place.

The housing assembly 62 may be used in combination with the cap 10 described previously with reference to FIGS. 1-6 and the termination assembly 44 described previously with reference to FIGS. 7-13 to form an electromagnetically shielded telecom connection jack as shown in FIGS. 21 and 22.

The invention claimed is:

1. A termination assembly for a modular telecom connection jack comprising, a contact block having an insulation displacement contact and a cutting member including a cutting blade, the contact block and cutting member being insertable into a housing assembly such that the cutting member is spaced from the insulation displacement contact and is aligned for operation, wherein when a wire is pressed into the insulation displacement contact, the cutting member will sever and remove excess wire protruding from the insulation displacement contact thus leaving a wire tail extending from the contact, and wherein a tail-receiving space is located through the cutting blade to receive and so avoid electrical contact with a free end of the wire tail, wherein the cutting blade is positioned such that the wire tail extends substantially within the spacing between the insulation displacement contact and the cutting blade.

2. A termination assembly for a modular telecom connection jack, according to claim 1, wherein the cutting member is a planar member and the tail-receiving space is defined by at least one aperture formed in the cutting member.

3. A termination assembly for a modular telecom connection jack, according to claim 1, wherein the cutting member is a planar member and the tail-receiving space is defined by at least one recess formed in the cutting member.

4. A termination assembly for a modular telecom connection jack, according to claim 1, wherein the cutting member is shaped to define the tail-receiving space in the form of a recessed channel.

5. A termination assembly for a modular telecom connection jack, according to claim 1, wherein the contact block includes a pair of insulation displacement contacts in a side-by-side configuration, and the termination assembly includes a pair of cutting members, the contact block and cutting members being insertable into the housing assembly such that each of the cutting members is aligned with and spaced from a respective contact.

6. A termination assembly for a modular telecom connection jack, according to claim 5, wherein the contact block includes four pairs of insulation displacement contacts arranged in two rows, and the termination assembly includes a pair of cutting members, the contact block and cutting members being insertable into the housing assembly such that each of the cutting members is aligned with and spaced from a respective row of contacts.

7. A termination assembly for a modular telecom connection jack, according to claim 1, further including a lacing fixture, the lacing fixture including at least one wire holding member and being interengageable with the contact block such that on engagement of the lacing fixture with the contact block the wire is pressed into a respective contact.

8. A termination assembly for a modular telecom connection jack, according to claim 7, wherein the lacing fixture is positioned within the spacing.

9. A termination assembly for a modular telecom connection jack, according to claim 8, wherein the lacing fixture has wire receiving recesses for receiving the wires, and slots for alignment with the insulation displacement contacts.

10. A termination assembly for a modular telecom connection jack, according to claim 9, wherein the contact block includes plural pairs of insulation displacement contacts arranged in plural rows, and the termination assembly includes a pair of cutting members, the contact block and cutting members being insertable into the housing assembly such that each of the cutting members is aligned with and spaced from a respective row of contacts.

11. A termination assembly for a modular telecom connection jack, comprising:

a contact block;

at least one contact positioned in the contact block;

a cutting member including a cutting blade having a tail-receiving space located therethrough, the cutting member being spaced from, and the tail-receiving space being laterally aligned with, the at least one contact; and a lacing fixture including at least one wire holding member comprising at least one wire receiving recess, the wire holding member being profiled to fit within the spacing between the contact and the cutting member;

wherein, when the lacing fixture and a wire are pressed into the contact block, the cutting member will sever and remove excess wire protruding from the contact leaving a wire tail extending from the contact with a free end of the wire tail located in the tail-receiving space of the cutting blade so as to avoid electrical contact with the free end of the wire tail.

12. A termination assembly according to claim 11, further comprising a housing assembly with the contact block and cutting member being insertable into the housing assembly with the cutting member spaced from the contact and aligned for operation.

13. A termination assembly according to claim 11, wherein the cutting member is a planar member and the tail-receiving space is defined by at least one recess formed in the cutting member.

14. A termination assembly according to claim 11, wherein the cutting member is shaped to define the tail-receiving space in the form of a recessed channel.

15. A termination assembly according to claim 14, wherein the contact block includes a pair of insulation displacement contacts in a side-by-side configuration, and the termination assembly includes a pair of cutting members, the contact block and cutting members being insertable into the housing assembly such that each of the cutting members is aligned with and spaced from a respective contact.

16. A termination assembly according to claim 11, wherein the contacts have an insulation displacement wire connecting section.

17. A termination assembly according to claim 16, wherein the lacing fixture has wire receiving recesses for receiving the wires, and slots for alignment with the insulation displacement contacts.

18. A termination assembly according to claim 17, wherein the contact block includes plural pairs of insulation displacement contacts arranged in plural rows, and the termination assembly includes a pair of cutting members, the contact block and cutting members being insertable into the housing assembly such that each of the cutting members is aligned with and spaced from a respective row of contacts.

* * * * *